United States Patent [19]

Hayes

[11] Patent Number: 4,620,176

[45] Date of Patent: Oct. 28, 1986

[54] CONTROL STICK MECHANISM

[76] Inventor: Charles L. Hayes, 770 Cromwell Way, Vista, Calif. 92083

[21] Appl. No.: 654,379

[22] Filed: Sep. 25, 1984

[51] Int. Cl.[4] ..... H01C 10/16

[52] U.S. Cl. ..... 338/128; 338/131; 200/61.52

[58] Field of Search ..... 338/127, 128, 131; 200/62, 63 R, 65, 66, 67 R, 61.52, 5 A, 5 R; 364/190

[56] References Cited

U.S. PATENT DOCUMENTS

| | | | |
|---|---|---|---|
| 2,929,258 | 3/1960 | Mackway | 338/128 X |
| 3,124,778 | 3/1964 | Youngbeck | 338/131 X |
| 3,394,611 | 7/1968 | Beurrier | 338/128 X |
| 3,497,856 | 2/1970 | Scheel | 338/131 X |
| 3,870,161 | 3/1975 | Cording | 338/128 X |
| 4,042,902 | 8/1977 | Meyer | 338/128 |
| 4,101,863 | 7/1978 | Lewicki | 338/128 |
| 4,427,176 | 1/1984 | Livet | 251/68 |
| 4,489,304 | 12/1984 | Hayes | 338/128 |
| 4,490,710 | 12/1984 | Kopsho, Jr. et al. | 338/128 |

OTHER PUBLICATIONS

Control Sticks Bolt Industrial Controls Catalog (no date) Simi Valley, CA 93063 (only data available).

TG Products Spec. Sheet (no date), Plano, Tex. 75074 (only data available).

Control Sticks Hayes Product Catalog (no date), San Marcos, CA (only data available).

"Positioning and Tracking Controls" Measurement Systems, Inc. Catalog (Excerpt) (no date), Norwalk, CT, 06854 (only data available).

TG Products "Instructions for Self Centering Toggle" (no date) Plano, Tex. 75074 (only data available).

*Primary Examiner*—Harold Broome

*Assistant Examiner*—M. M. Lateef

*Attorney, Agent, or Firm*—Price, Gess & Ubell

[57] ABSTRACT

A control stick device having a switch disabled stick bias, a screw-adjustable biasing of internal potentiometers, and a one-piece frame for receiving a snap-fit stick element.

11 Claims, 6 Drawing Figures

CONTROL STICK MECHANISM

BACKGROUND OF THE INVENTION

The subject invention relates to a "joystick" control device, and more particularly to such a control device useful in connection with drawing on computer displays and with electronic game and other toy apparatus.

In the prior art, control sticks are known in which a ball-and-socket rotatable stick member is mechanically linked to orthogonal fork members to drive respective X and Y axis potentiometers. With the increasing sophistication of computer graphics apparatus and electronic games, a need has arisen to provide additional control modes and simplified, flexible adjustment of such modes. There is also a continuing need to reduce the cost of the control stick mechanism.

SUMMARY OF THE INVENTION

It is therefore an object of the invention to provide an improved control stick apparatus.

It is another object of the invention to expand the control features available with a control stick device, while providing simple feature selection mechanisms.

It is another object of the invention to provide a control stick apparatus with simplified manufacturing and assembly features.

These and other objects are achieved by a control stick device employing an adjustment feature which enables biasing of the associated potentiometers through a geared mechanism and one-step disabling of spring-biased return members used to maintain the control stick in a centered position. The preferred embodiment features a single piece frame structure with a snapably-insertable ball and stick member, reducing the multiplicity of parts required by the structure.

BRIEF DESCRIPTION OF THE DRAWINGS

The preferred embodiment and best mode of implementing the just-summarized invention will now be described in conjunction with the drawings of which.

DETAILED DESCRIPTION OF THE PREFERRED EMBODIMENT

Figure 1:
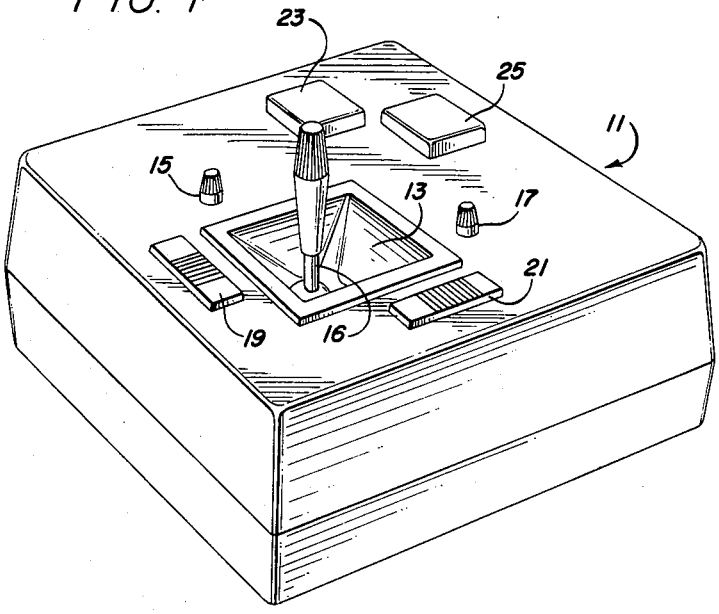
FIG. 1 is a perspective view of a joystick control according to the preferred embodiment

FIG. 1 illustrates a control box 11 having a control stick mechanism 13 including a control stick shaft 16 mounted therein. The box includes rotatable adjustment members 15, 17 and slidable adjustment switches 19, 21. Control buttons 23, 25 are also provided.

Figure 2:
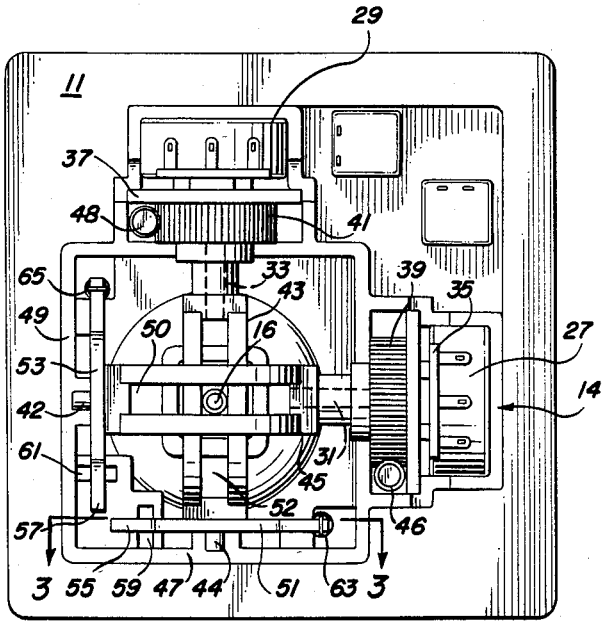
FIG. 2 is a bottom view illustrating the control mechanism of the preferred embodiment.

The bottom view of FIG. 2 illustrates the control stick mechanism 13, which includes a frame 14 mounting various parts of the mechanism 13. These parts include first and second potentimeters 27, 29 having shafts 31, 33. Each potentiometer 27, 29 is attached to a respective plate 35, 37, which is integrally formed with a respective gear 39, 41. The potentiometer shafts 31, 33 rotate within and with respect to the gear plate combinations 35, 39; 37, 41, and are press-fit into respective orthogonal fork members 43, 45. Worm shafts 46, 48 are integrally formed with the adjustment members 15, 17 and mesh with the gears 39, 41.

Each fork member 43, 45 is pivotally mounted in a respective side 47, 49 of the frame 14 by means of respective pins 44, 42 formed as an integral part of the fork members 43, 45. The fork members 43, 45 bear respective slots 50, 52. The shaft 16 of the joystick mechanism 13 extends through the slots in each fork member 43, 45, providing an X drive to fork 43 and a Y drive to fork 45.

The apparatus further includes first and second return members 51, 53 for returning the control stick to a central position. The first return member 51 is pivotally mounted by a pin 59 at one of its ends 55, and the second return member 53 is pivotally mounted by a pin 61 at one of its ends 57. The opposite ends of each return member 51, 53 are attached via bias springs 63, 65 to the frame 14.

Figure 3:
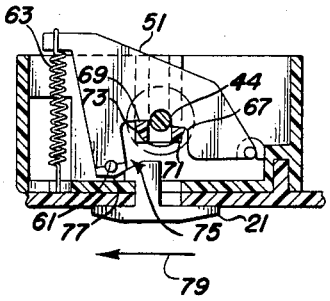
FIG. 3 is a sectional view taken along Section 3—3 of FIG. 2, illustrating biasing apparatus according to the preferred embodiment.

One of the return members 51 is shown in more detail in FIG. 3. As shown, the return member 51 is contoured to pivot about the pin 44 of the fork member 53. The return member 51 has a first surface 67 and a second surface 69 stepped-up from the first surface 67. The first and second surfaces 67, 69 normally abut complementary detents 71, 73 formed on the fork 43. The detents 71, 73, surfaces 67, 69 and spring 63 interact such that a departure of the fork 43 from its central position exerts a force against the bias of spring 63. The interaction of the spring 63, return member 51 and detents 71, 73 maintain the fork 43 in the center of its permitted arc of travel. The other return member 53 is preferably a mirror image of member 51 and functions to bias the fork 45 in the center of its permitted arc of travel.

As further shown in FIG. 3, a cam 75 is provided on each of the slide switches 19, 21. The cam 75 interacts with a beveled surface 77 on the return member 51. When the switch 21 is moved in the direction of the arrow 79, the cam 75 exerts a force against the spring bias and drives the return member 53 out of engagement with the detents 71, 73, disabling the return mechanism. Sliding the control switch 21 in the opposite direction of the arrow 79 re-enables the return mechanism. Disabling and enabling the return mechanism is accomplished without manipulation of the control stick itself.

Figure 4:
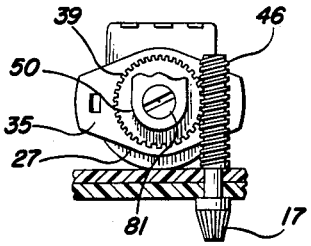
FIG. 4 illustrates the potentiometer adjustment mechanism of the preferred embodiment.
Figure 5:
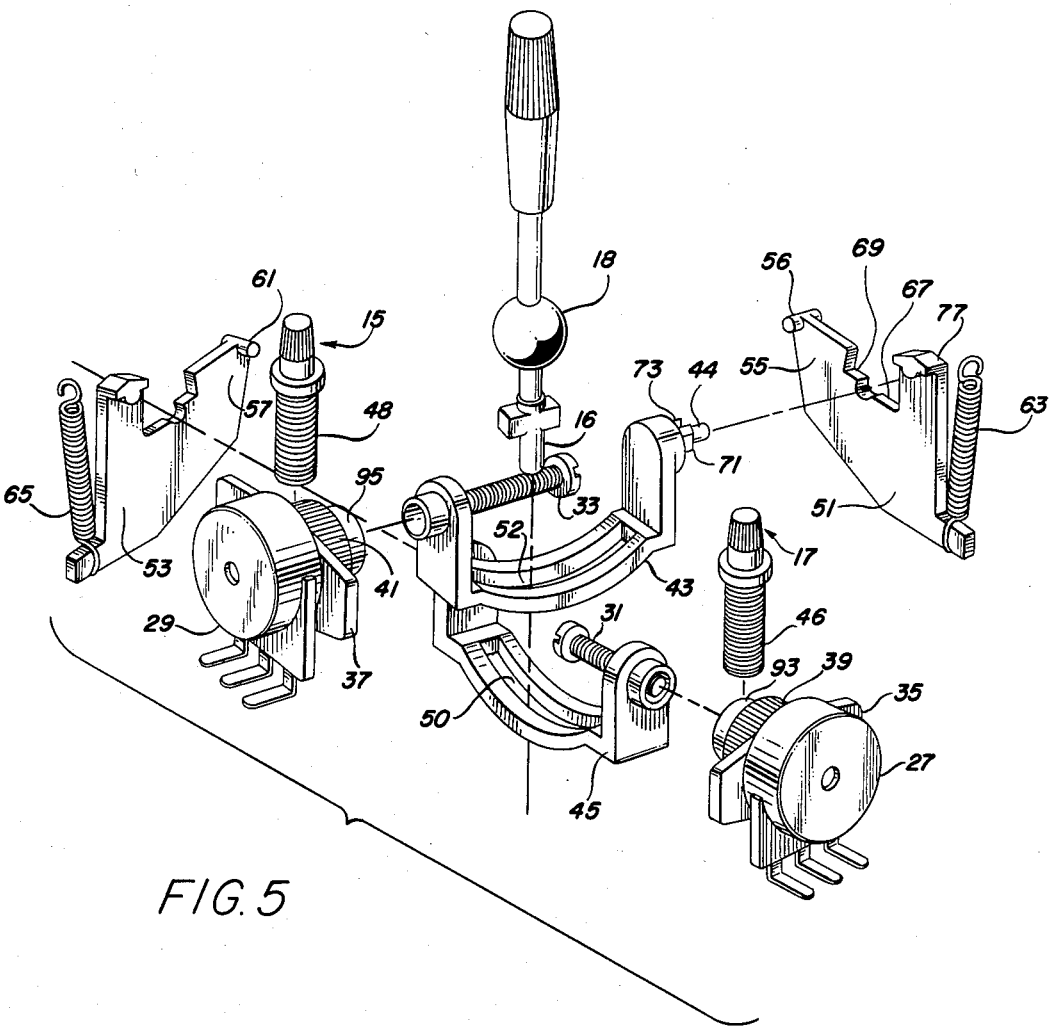
FIG. 5 is an exploded perspective view of the preferred embodiment.

Turning to FIG. 4, it may be seen that the worm shaft 46 extends into the housing 11, where its threads engage the gear 39 attached to the plate 35. Turning the adjustment member 17 pivots the associated potentiometer 27 with respect to its shaft, providing the capability to adjust or preset the starting position of a display feature in an X-Y grid under control of the preferred embodiment. This feature provides a 60% increase in the maneuverabilty of the starting position.

Figure 6:
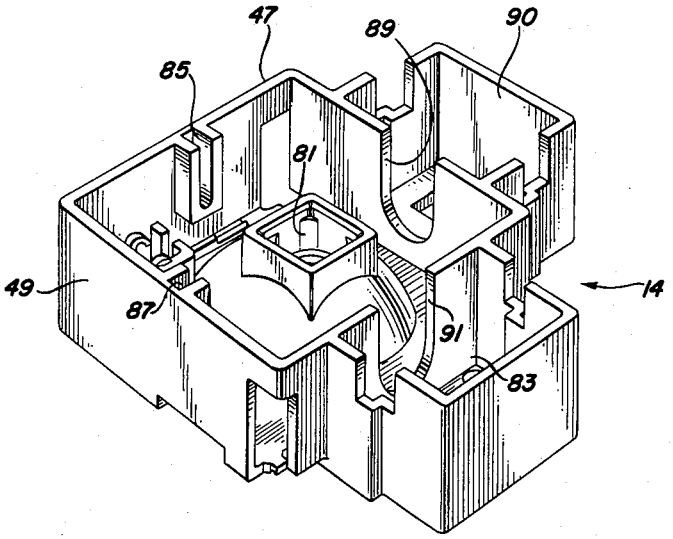
FIG. 6 is a perspective of the frame member of the preferred embodiment.

The control stick mounting is improved in the preferred embodiment by the use of a one-piece metal stick 16 and ball 18 in combination with a plastic socket 81 (FIG. 6) in the frame 14. By properly tolerancing molding of the plastic socket 81, the ball 16 may be snapped into the frame 14, avoiding the necessity for a multiplicity of parts and additional assembly steps to retain the ball 16. The frame 14 is advantageously of a one-piece molded plastic construction, further simplifying manufacture and assembly. The molded features include mounting spaces 83, 90 for the potentiometer mechanisms 27, 35, 39 and 29, 37, 41. Slots 89, 91 provide bearing surfaces for the collars 93, 95 of the gears 39, 41, leaving the potentiometers 27, 29 free to rotate with respect to the enclosing spaces 90, 83 in the frame 14. The frame further includes slots 85, 87 for retaining the fork pins 42, 44, as well as complementary mounting apertures for the mounting pins 59, 61 of the return members 51, 53.

As will be apparent, the just-described preferred embodiment is subject to numerous modifications and adaptations without departing from the scope and spirit of the invention. Therefore, it is to be understood that, within the scope of the appended claims, the invention may be practiced other than as specifically described herein.

What is claimed is:

1. An apparatus including first and second potentiometers, said potentiometers drivable by a control stick comprising:

a housing means;

said first and second potentiometers comprising respective first and second potentiometer housings having respective first and second rotatable shafts mounted therein;

first and second gear means affixed to said first and second potentiometer housings, respectively, said first shaft extending through said first gear means and being rotatable with respect to said first gear means; said second shaft extending through said second gear means and being rotatable with respect thereto;

first and second orthogonal fork member means connected to said first and second shafts, respectively, and mounted in said housing means for rotation through an arc with respect to said housing means; and means for driving each said gear means pivot the attached potentiometer housing with respect to the shaft mounted therein, thereby adjusting the potentiometer setting corresponding to a particular position of said form means.

2. The apparatus of claim 1 further including means for biasing said fork member means to return to a central position.

3. The apparatus of claim 2 wherein said first and second fork member means each bear first and second detents and wherein said biasing means comprises:

first and second return means each having a beveled surface, a contoured surface and a pivotal mounting means at a first end thereof mounted in said housing;

means for biasing a second end of each said return means in a position wherein said first and second detents and said contoured surface interact to return each said fork member means to a selected position of its respective arc; and switch means slidably mounted in said housing having a cammed surface thereon, said cammed surface being movable with respect to a said beveled surface to pivot a said contoured surface out of contact with its corresponding detents, thereby preventing said biasing means from returning said fork means to said selected position.

4. The apparatus of claim 3 wherein said housing means includes a plastic socket and wherein said control stick mounts a metal ball, said ball being snap-fitted into said socket.

5. The apparatus of claim 4 wherein said housing includes a unitary frame member, said frame member including said socket and mounting means for said apparatus.

6. The apparatus of claim 5 wherein each said first and second gear means has a collar thereon, wherein each said fork member means has a pin on one end thereof, and wherein each said return means has a pin at one end thereof and wherein said frame member means includes a pre-formed bearing surface for the respective collars of said first and second gear means and mounting means for said pins of each said fork member means and return means.

7. In a joystick control apparatus, the apparatus comprising:

a potentiometer having a body and a shaft means responsive to movement of said joystick;

a gear means fixed to said potentiometer and rotatable with respect to said shaft; and means for rotating said gear means and body to a selected position with respect to said shaft, thereby adjusting the characteristic of said potentiometer associated with a selected position of said joystick.

8. An apparatus drivable by a control stick comprising:

a housing means;

first and second potentiometers having respective first and second rotatable shafts;

first and second gear means affixed to said first and second potentiometer, respectively, said first shaft extending through said first gear means and being rotatable with respect to said first gear means; said second shaft extending through said second gear means and being rotatable with respect thereto;

first and second orthogonal fork member means connected to said first and second shafts, respectively, and mounted in said housing means for rotation through an arc with respect to said housing means;

first and second detents at one end of each of said first and second fork members;

means for driving each said gear means to pivot said potentiometer with respect to said shaft, thereby adjusting the potentiometer setting corresponding to a particular position of said fork means;

first and second return means each having a beveled surface, a contoured surface and a pivotal mounting means at a first end thereof mounted in said housing;

means for biasing a second end of each said return means in a position wherein said first and second detents and said contoured surface interact to return each said fork member to a selected position of its respective arc; and switch means slidably mounted in said housing having a cammed surface thereon, said cammed surface being movable with respect to a said beveled surface to pivot a said contoured surface out of contact with its corresponding detents, thereby preventing said biasing means from returning said fork means to said selected position.

9. An apparatus drivable by a control stick comprising:

a housing means;

first and second potentiometers having respective first and second rotatable shafts;

first and second orthogonal fork member means connected to said first and second shafts, respectively, and mounted in said housing means for rotation through an arc with respect to said housing means;

first and second detents at one end of each of said first and second fork members;

first and second return means each having a beveled surface, a contoured surface and a pivotal mounting means at a first end thereof mounted in said housing;

means for biasing a second end of each said return means in a position wherein said first and second detents and said contoured surface interact to return each said fork member means to a selected position of its respective arc; and switch means slidably mounted in said housing having a cammed surface thereon, said cammed surface being movable with respect to said beveled surface to pivot said contoured surface out of contact with its corresponding detents, thereby preventing said biasing means from returning said fork means to said selected position.

10. Joystick apparatus comprising:

a housing;

a plate;

a potentiometer means having a shaft and a body for providing a variable resistance in response to rotation of said shaft, said potentiometer body being pivotable with respect to said housing and rigidly attached to said plate;

gear means integrally formed with said plate;

drive means for rotating said gear means, thereby rotating said potentiometer body with respect to said housing and said shaft to thereby impart a bias setting to said potentiometer; and joystick means for rotating said shaft.

11. An apparatus drivable by a control stick comprising:

a housing means;

potentiometer means having a rotatable shaft;

fork member means mounted in said housing means and connected to said rotatable shaft for rotation with respect to said housing means, said fork member means having detent means at one end;

return means having a beveled surface, and a contoured surface at a first end, said return means being pivotally mounted in said housing means at the first end;

means for biasing a second end of said return means in a position wherein said detent means and said contoured surface interact to return said fork member means to a selected position; and switch means slidably mounted in said housing means and movable with respect to said beveled surface to pivot the contoured surface on said return means out of contact with said detent means, thereby preventing said biasing means from returning said fork means to said selected position.

* * * * *